US005117794A

United States Patent [19]

Leshner et al.

[11] Patent Number: 5,117,794

[45] Date of Patent: Jun. 2, 1992

[54] FUEL INJECTION SYSTEM

[75] Inventors: Michael D. Leshner; Ernest W. Chesnutis, Jr.; Christian Williams, all of Columbia; Ronald Stouffer, Silver Spring, all of Md.

[73] Assignee: Bowles Fluidics Corporation, Columbia, Md.

[21] Appl. No.: 330,927

[22] Filed: Mar. 28, 1989

Related U.S. Application Data

[63] Continuation of Ser. No. 728,902, Apr. 30, 1985, abandoned.

[51] Int. Cl.[5] ..... F02M 51/02

[52] U.S. Cl. ..... 123/444; 137/830; 137/831

[58] Field of Search ..... 123/444, DIG. 10, 472; 261/DIG. 69; 137/831, 829, 830, 832

[56] References Cited

U.S. PATENT DOCUMENTS

| | | | |
|---|---|---|---|
| 2,812,980 | 11/1957 | Kadosch et al. | 299/122 |
| 3,266,511 | 8/1966 | Turick | 137/831 |
| 3,266,512 | 8/1966 | Turick | 137/831 |
| 3,269,419 | 8/1966 | Dexter | 137/831 |
| 3,530,871 | 9/1970 | Greenblott | 137/81.5 |
| 3,545,466 | 12/1970 | Bowles | 137/81.5 |
| 3,576,182 | 4/1971 | Howland | 123/119 |
| 3,598,096 | 8/1971 | Timpner | 123/444 |
| 3,638,671 | 2/1972 | Harvey et al. | 137/81.5 |
| 3,679,185 | 7/1972 | Nardi | 123/DIG. 10 |
| 3,782,639 | 1/1974 | Boltz et al. | 239/405 |
| 3,931,814 | 1/1976 | Rivere | 123/438 |
| 4,150,641 | 4/1979 | Masui | 123/444 |
| 4,280,661 | 7/1981 | Tanasawa et al. | 239/409 |
| 4,289,104 | 9/1981 | Takada et al. | 123/472 |
| 4,391,299 | 7/1983 | Holmes | 137/831 |
| 4,475,486 | 10/1984 | Kessler | 123/52 M |
| 4,532,904 | 8/1985 | Osawa et al. | 123/580 |

FOREIGN PATENT DOCUMENTS 8403335 8/1984 PCT Int'l Appl. .

OTHER PUBLICATIONS

"Electronic Fuel Injection", Randolph, Oct. 1984, Popular Science, pp. 73–75.

Automotive Engineering, Oct. 1983, pp. 40–41.

Automotive Engineering, Oct. 1984, pp. 44–45.

Pamphlet-"High Technology From Buick", "The 3.8 SFI Turbo".

*Primary Examiner*—Andrew M. Dolinar

*Attorney, Agent, or Firm*—Jim Zegeer

[57] ABSTRACT

A bistable fluidic switch is switched from its stable state by a pin inserted in the power nozzle of the bistable fluidic switch, the pin being controlled by an electromagnetic actuator which is controlled from an electronic computer. The fluidic switch element has a crossover type interaction region and a common outlet leading to a pair of output passageways, one of which returns fuel to the supply tank, and the other of which leads to the air intake manifold of the engine. Air is introduced into the output passageway leading to the engine so as to air atomize the fuel before injection of same into the air intake manifold.

24 Claims, 3 Drawing Sheets 12T
12
20
9
13
14
26
15
10
11
FUEL TO ENGINE
17
18
16
19
24
22
23
COMPUTER
ENGINE DATA SENSORS
FUEL TO TANK
21

AIR
TO ENGINE
26
.016" DEEP
FUEL SUPPLY
12
.030"
.016" DEEP
.043"
12T
.021" DIA
RETURN TO TANK
14
.021"
15
.030"
17
18
96
.050" DEEP

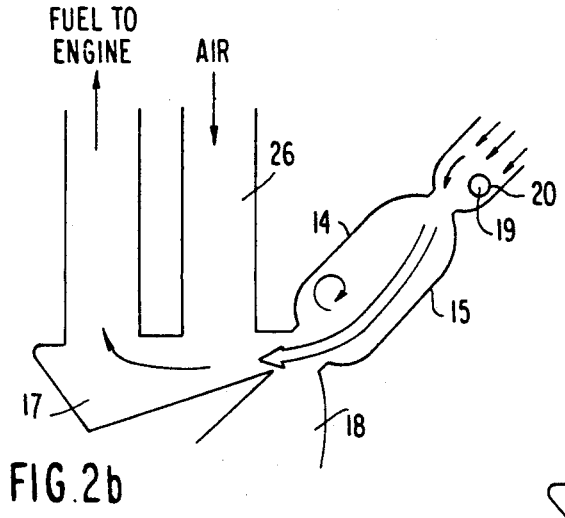
FIG.2b
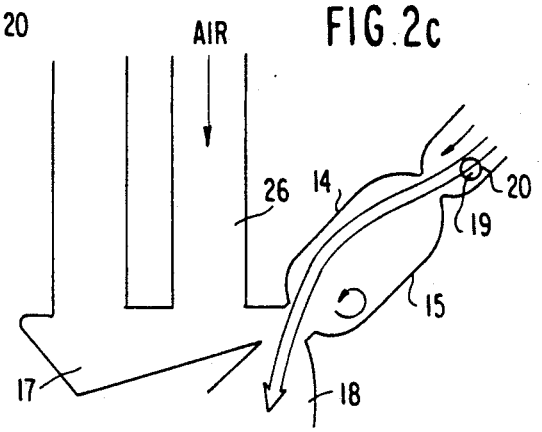
FIG.2c
FIG.3
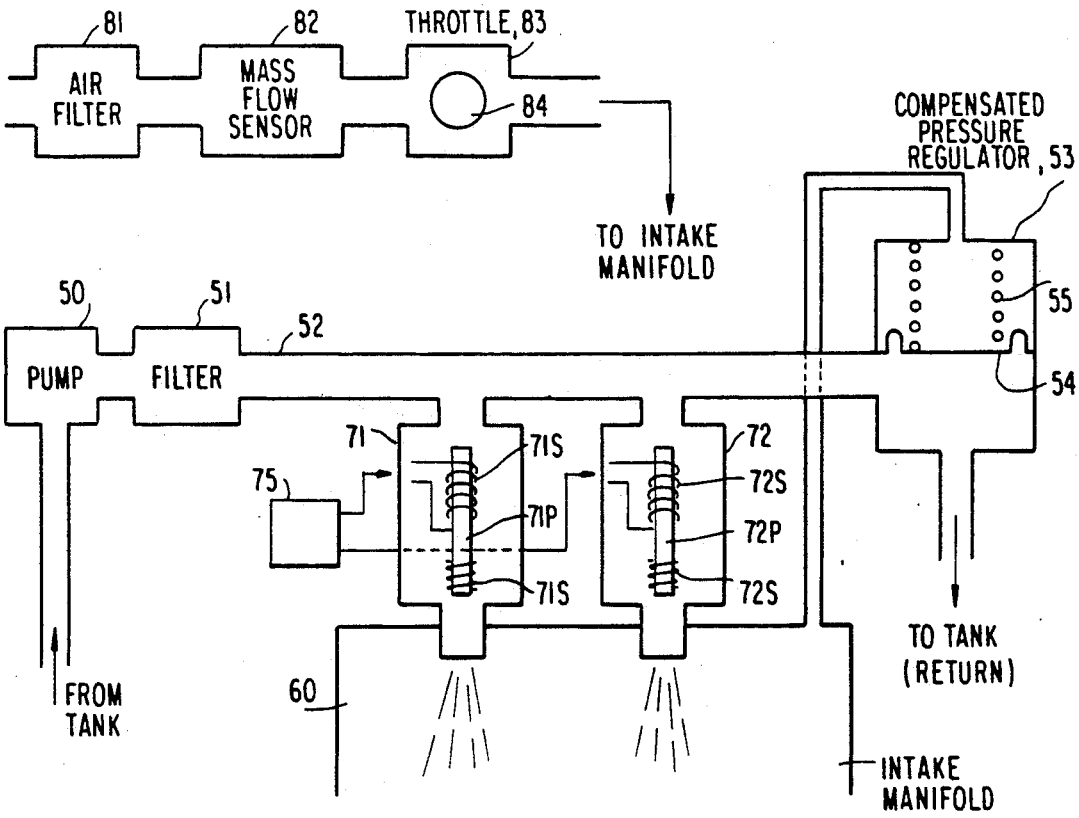

FUEL INJECTION SYSTEM

REFERENCE TO RELATED APPLICATIONS

This application is related to the application of Ronald D. Stouffer, U.S. Ser. No. 470,791, filed Feb. 28, 1983 and entitled "Improved Fluidic Transducer for Switching Fluid Flow", assigned to the assignee hereof, now U.S. Pat. No. 4,565,220, issued Jan. 21, 1986.

BACKGROUND AND BRIEF DESCRIPTION OF THE INVENTION

In fuel management systems for internal combustion engines, on-board computers are currently supplied with data from sensors monitoring various engine operating parameters, such as RPM, temperature, exhaust gas characteristics, mass air flow through the air intake manifold, accelerator pedal position, etc., to determine the proper fuel-air ratio for fuel economy, smoothness of engine operations and compliance with emission standards. The electrical control signals are supplied to a solenoid controlled fuel injection valve which typically is biased closed by a spring so that a large electrical current is required to open the valve. In this example, while modern electronic computers and microprocessors have been developed to provide highly accurate control signals for controlling liquid flow, the control devices per se have typically been a solenoid controlled mechanical valve which have difficulty in accurately tracking electrical signals and delivering short liquid pulses mainly because of their large pintle mass which is magnified in the case of springs biasing them closed. The leading edge in particular of the liquid pulse delivered to the utilization system is not sharp. In the case of solenoid controlled fuel injectors for internal combustion engines, the output nozzles are very sensitive to fluid loading so that if a passageway to direct the output fuel pulse to a specific port intake target were attached, the performance is severely degraded. Reference is made to the article entitled "Electronic Fuel Injection" by Randolph, October 1984, Popular Science, pages 73–75; Automotive Engineering, October 1983, pages 40–45 and the phamplet "High Technology from Buick", "the 3.8 SF Turbo".

Significant improvements in such systems have been provided in the above-identified related application of R. D. Stouffer wherein a bistable fluidic switch element with a cross-over type interaction chamber leading to a common outlet and to a pair of output passageways, one of the output passageways leading to the engine and the other leading to the supply tank. The bistable switch was reliably switched using a pair of control ports which had control tubes coupled thereto and shaken in prescribed manner by a solenoid which, in turn, was controlled by the on-board computer or microprocessor. In the Stouffer system, individual fuel return from each injectior provides for "flushing" of fuel vapor bubbles which might enter the fuel inlet. The conventional system described earlier herein (and described more fully hereafter) has no means for flushing out a vapor bubble once it has entered the inlet. This feature allows the bistable fluidic switch system to use a lower system fuel pressure (on the high pressure rail). Current systems (such as those marketed by Robert Bosch) use approximately 27 to 37 psi to avoid the formation of vapor bubbles. Lower pressure systems require less complexity and less expensive pump.

An object of the present invention is to provide an improved fuel injection system of the type disclosed in the above-referenced Stouffer application. A further object of the invention is to provide improvements in fuel injection systems generally, particularly with respect to method and apparatus for improving the engine performance thereof.

According to one major feature of the invention, a switch pin is projected into and out of intrusion position in the flow path of fluid in the power nozzle of the fluidic element to cause switching in the chamber of the bistable switch. In other words, the use of side channels or control ports is eliminated and the fuel switching is accomplished solely by the interposition of a pin in the power nozzle thus simplifying the construction of the fluidic itself, eliminating small flow passages and the like and, at the same time, improving the response time, since there is no flow of fluid inside channels or delay involved in such flow. In a preferred embodiment, the axis of the power nozzle is canted relative to the axis of the chamber of the fluidic element so that in the absence of the pin, the switch is in one predetermined state and is switched form that state to the other state by pin intrusion and always returns to that predetermined state on removal of the intrusion pin.

A second major feature of the invention is that air is supplied to each injector at a point in the output flow passage leading to the engine so as to pre-air atomize the fuel before injection of same into the air intake manifold on the engine. This has the following advantages:

A. It makes the flow calibration insensitive to changes in manifold vacuum—thereby eliminating the need to compensate the supply pressure for changes in manifold vacuum.

B. It improves the quality of the fuel/air spray which is of primary importance in fuel/air mixture preparation. Improved spray (smaller droplets) and distribution in the air stream flowing in the air intake manifold results in a greater degree of fuel vaporization, yielding more complete combustion. The improvements is manifested by smoother engine idle and substantial minimization of "idle shake".

C. For improved cold/warm-up operation, air supplied to the injectors may be selectively preheated, to improve early fuel vaporization characteristics. This technique is more effective than heating 100 percent of the combustion air during the first few minutes after a cold start (when very little heat is available). Thus, improved warm-up exhaust emissions will result.

D. Air supplied directly to the injectors is accounted for by the engine control computer. When the air flow is computed based on the manifold absolute pressure, the injector air is accounted for by its effect on manifold pressure. In a fuel metering system which makes use of direct air mass flow measurement, the source of injector air is downstream of the mass flow sensor. In either case, the source of injector air is derived from a source downstream of the combustion air filter.

E. The injector air flows in proportion to the manifold vacuum (atmospheric pressure minus manifold absolute pressure), producing the best spray (smallest droplet size) under idle and light load conditions, when the vacuum is high—(15–20 in.hg.) and coincidentally, the engine combustion is most sensitive to droplet size at idle and light load conditions.

F. Finally, the pin has a low mass. The low mass electromechanical actuator allows the injector to turn on and off with less delay than conventional injectors.

This results in a flow calibration which maintains its linearity at pulse widths below 2 msec.

G. The introduction of air isolates the high vacuum condition of the engine from the fluidic element. Air enters the engine output leg of the fluidic element so that particular point does not see the vacuum of the intake manifold. There is not enough air added to greatly effect engine vacuum. The power nozzle then becomes the major source of pressure drop of the fluid in the system.

In the preferred embodiment, both major features are utilized but it will be appreciated that either feature can be used independently of the other and still obtain advantages of the invention.

Thus, the basic objective of the invention is to provide an improved fuel injection system for internal combustion engines. A further object of the invention is to provide an improved bistable fluidic switch which has no control ports or passages; and a further object of the invention is to provide an improved fuel preparation by the addition of filtered and monitored air to fuel for internal combustion engines prior to induction in the engine.

BRIEF DESCRIPTION OF THE DRAWINGS

The above and other objects, advantages and features of the invention will become more apparent when considered with the following specification and accompanying drawings wherein:

FIG. 3 is a schematic block diagram of a prior art (Bosch) fuel injection system which is currently commercially available.

DETAILED DESCRIPTION OF THE INVENTION

Figure 1:
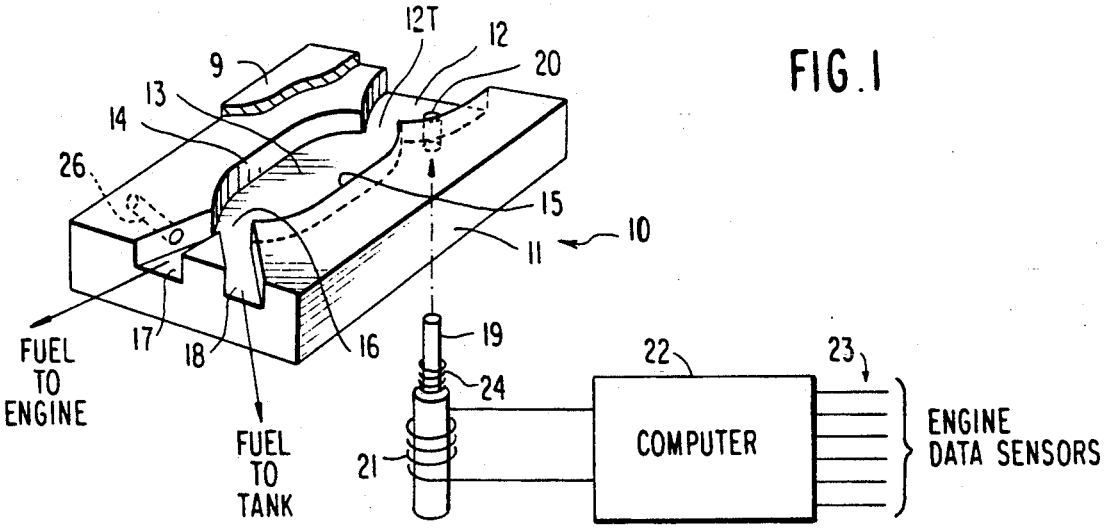
FIG. 1 is a isometric view of a bistable fluidic switch according to the invention, FIG. *2a* is an enlarged plan silhouette view of an actual operating unit with exemplary dimensions thereon, FIG. *2b* is a silhouette of FIG. 2 showing the flow path with the pin intruding or projecting position in a flow path in the power nozzle, FIG. *2c* shows the flow paths with the pin in unintruding or retracted position.
Figure 2A:
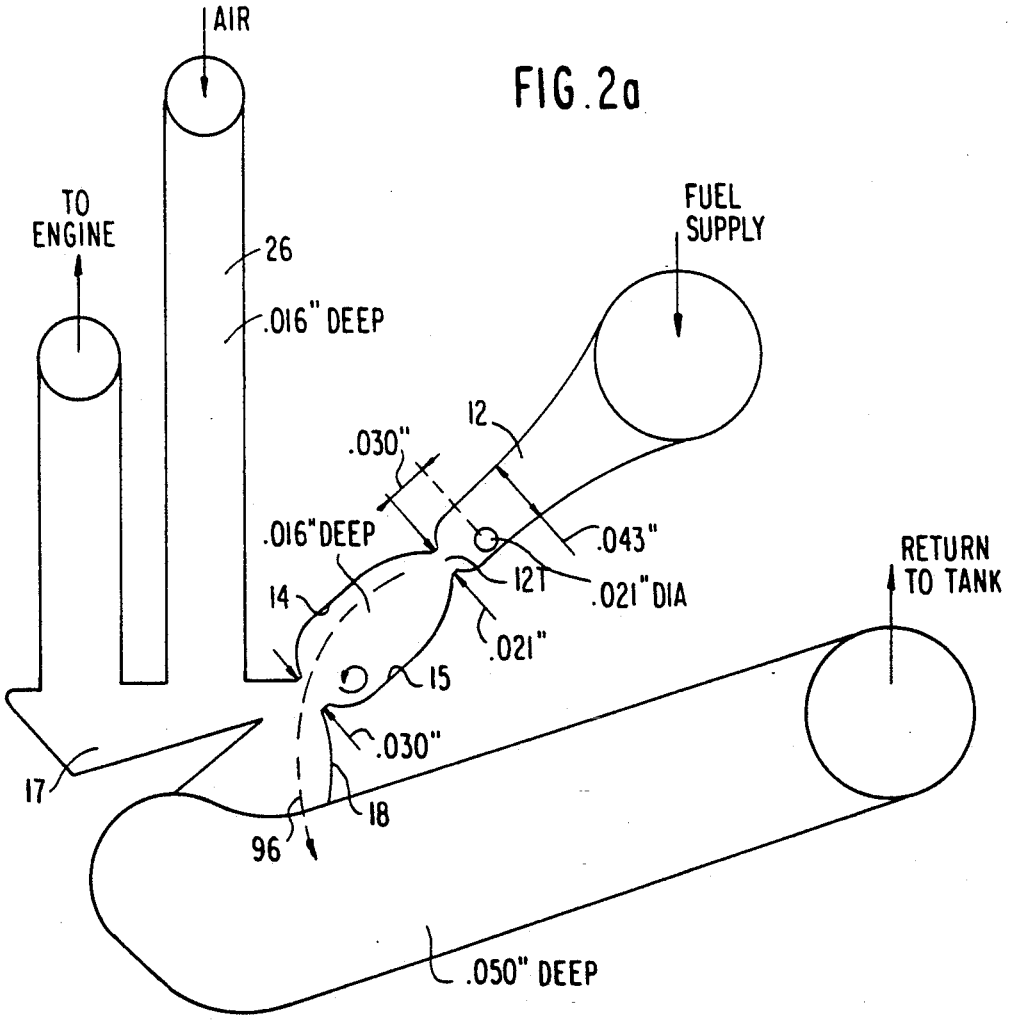

Referring now to FIGS. 1 and 2, the bistable fluidic switch 10 includes a body member 11 with a power nozzle 12 issuing fluid into chamber 13 formed with sidewalls 14 and 15 which diverge relative to the power nozzle and converge relative to common outlet 16 leading to a first output passage 17 which conveys fuel to the engine and a second output passage 18 which conveys unused fuel to a return rail to the supply or tank. The bistable fluidic switch 10 has the exemplary silhouette shown in FIG. 2 and the flow paths which will be described more fully hereafter.

Switch control pin or pintle 19 is moved through the transverse bore hole 20 by electromagnetic coil 21 which receives control signals from conventional on-board computer 22 which, in turn, receives a plurality of engine and performance data parameter signals on its input lines 23 from the various engine sensors and signal transducers (not shown). A spring 24 biases the pintle or pin and its driving armature to a neutral or non-intruding position. Passage 26 supplies air from the air intake to air atomized fuel in outlet passage 17 and isolates the fluidic from the vacuum thus making the flow calibration insensitive to changes in manifold vacuum thereby eliminating the need to compensate the supply pressure for changes in manifold vacuum. It also improves the quality of fuel spray which is of primary importance in fuel/air mixture preparation. The improved spray results in smaller droplets to produce a greater degree of vaporization and hence, more complete combustion. This improvement is manifested by smoother engine idle. For improved cold/warm-up operation, air supplied to the injectors may be selectively preheated to improve early evaporation characteristics. Since this is relatively low volume of air is supplied to each of the injectors, it can be heated using electric heater thermostatically controlled (not shown) in air rail line 98. This technique is more effective than heating 100 percent of the combustion air during the first few minutes after a cold start. It also results in improved warm-up exhaust emissions. That is, the emissions are reduced.

Moreover, the air supplied directly to the injectors is accounted for by the engine control computer 22. When the air flow is computed based on manifold absolute pressure, the injector is accounted for by its effect on manifold pressure. In a fuel metering system which makes use of direct air mass flow measurement, the source of inject air is downstream of the mass air flow sensor and of the combustion air filter. Finally, the injector air flow is in proportion to the manifold vacuum (atmospheric pressure minus manifold absolute pressure) thus producing the best spray pattern (smallest droplet size) under idle and light load conditions, when the vacuum is high (15–20 InHg). Coincidentally, the engine combustion is most sensitive to droplet size at idle and light load conditions.

The pintle or pin 19 is of very low mass. Thus, this low mass electromechanical actuator allows the injector to turn on and off with less delay than conventional Bosch type injector. This results in a flow calibration which maintains its linearity at pulse widths below 2 msec.

A cover 9 seals the bistable switch, the passages to the power nozzle 12, return fuel passages and fuel to engine passage are all sealed and secured to body member 11 for, in this embodiment, direct substitution in a conventional multi-point fuel injection. The air input 26 is connected to air rail 98 by short pipe section 99.

As shown in FIG. *2b*, when the pin 19 is in an intruding position, it is specifically located in a region to the right of the center line through the power nozzle 12 and upstream of the throat 12T of the power nozzle a short predetermined distance. It is essentially within this sector that the pin is most effective in effecting a switch. The design of the fluidic is such that in the normal case with the pin in non-intruding position the axis of the power nozzle 12 is canted about 8 degrees relative to the axis of chamber 13 so that the fuel will flow through passage 18 and return to the tank (as shown in FIG. *2c*). When the pin intrudes in the flow path in the power nozzle, it will cause a deflection of the jet of 15 to 16 degrees. The chamber effectively amplifies this deflection to cause the jet to travel along wall 15 and pass through common outlet 16 and be directed into outlet passage 17 leading to the engine, as shown in FIG. *2b*. Thus, the chamber first diverges and then converges and reverses the direction of flow of fluid through the different sides to the different output passages, namely, output passage 17 and output passage 18 as shown in FIGS. *2a*, *2b* and *2c* and is characterized in the above-identified Bowles U.S. Pat. No. 3,545,466 as a diverging-converging reversing chamber.

As noted above, the bistable fluidic switch element has a chamber of the type wherein the sidewalls converge to a common outlet 16. The common outlet 16 with its converging sidewalls 13C and 14C isolate this chamber from the output channels 17 and 18 and the converging sidewalls generate vortices for maintaining the liquid flowing in the channels on one of the sidewalls until switched by operation of the pin.

The switching element is bistable such that it is in one stable state or the other which is maintained in that condition by the feedback constituted by the vortex 30 which is generated by a portion of the power stream which is peeled off by the opposite wall. Since the chamber is of the cross-over type, it serves to isolate the interaction region from pressures downstream of the throat or outlet.

Figure 4:
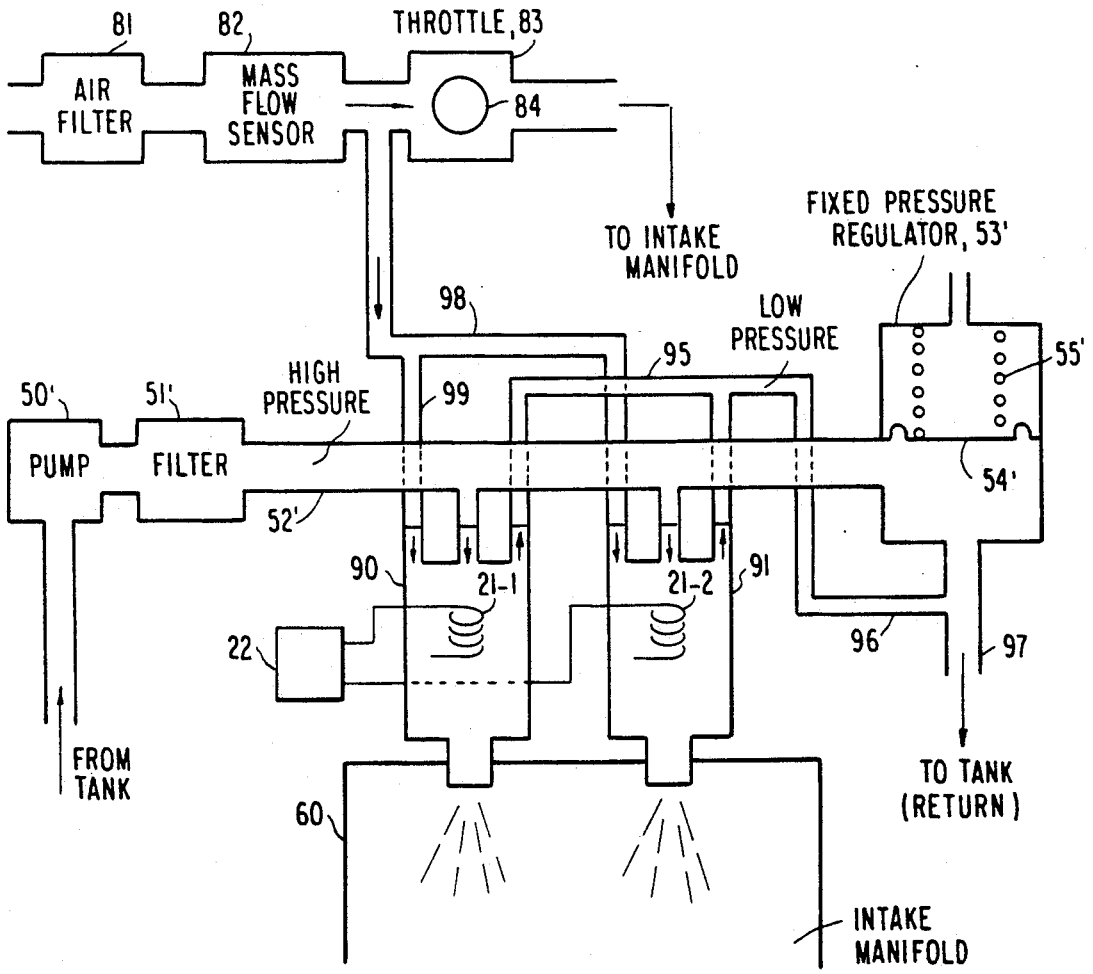
FIG. 4 is a fuel injection system incorporating the invention.

Referring now to FIGS. 3 and 4, FIG. 3 illustrates diagrammatically a conventional fuel system (referred to in the art as the "Bosch" fuel injection system) in which a tank T delivers fuel via pump 50 through a fuel filter 51 to a fuel rail 52 which has the pressure therein regulated by a compensated pressure regulator having a spring biased diaphram 54 defining the regulator chamber into two chambers, one side of which is coupled to the air intake manifold 60 by a compensating air pressure line 61. The fuel injectors 70, 71 have a solenoid control injection valve which is typically biased closed by a spring so that a large electrical current is required to open the valve. Then fuel management system for the internal combustion engine of the automobile includes an onboard computer which is supplied with data signals from sensors monitoring various engine operating parameters, such as RPM, temperature, exhaust gas characteristics, mass air flow, etc., an determines the proper fuel-air ratio for fuel economy, efficiency and smoothness of engine operations and compliance with emission standards. As diagrammatically illustrated, the computer 75 supplies individual signals to control each of the solenoids 71S, 72S of the injector 71 and 72, each of the injectors having a relatively large mass pintle 71P and 72P, respectively, which are seated in a valve seat (not shown) by a spring 71S, 72S for the purpose of injecting fuel into the intake manifold induction pipe 60-1, 60-2 for each cylinder of the engine. It will be appreciated that while the prior art system disclosed is for a conventional multi-point injection system, similar system is also used for single point injection where a single injector is typically included and mounted in the body of the throttle (referred in the art as throttle body injection or TBI).

The intake manifold 60 has a separate air induction pipe for each cylinder of the engine two of which are shown 60-1 and 60-2, each being provided with a separate fluidic injector which is connected in parallel to fuel supply or pipe rail 52. The same schematic applies to 4, 6 or 8 injectors. Air is drawn through air filter 81 and passes through the mass flow sensor 82 to throttle 83. Throttle plate 84 is controlled by the operator and controls the flow area in the throttle air passage and thus the mass air flow to the engine cylinders via the induction pipes for each cylinder.

The system incorporating the present invention is shown in FIG. 4 and includes the pump 50 for pumping fuel from the tank (not shown) through a filter 51 to a fuel rail 52 which supplies the fuel under pressure to each of the injectors 90, 91 which are fluidic fuel injectors having the silhouette illustrated diagrammatically in FIG. 1 with exemplary dimensions illustrated in FIG. 2. Fuel under pressure in fuel rail line 52 is introduced into the power nozzle 12 from rail 52' for each of the fuel injectors and in parallel. Fuel which is not delivered to the engine is returned at a somewhat lower pressure to a return fuel rail 95 from each of the bistable fluidic injectors whenever the fuel is traveling on the side 14 of chamber 13 taking the path indicated by the arrow 96 (FIG. 2) and is returned to the tank via line 97. A fixed pressure regulator 53' has a diaphram 54' biased by a spring 55' so as to maintain the fuel pressure at a relatively constant value.

Air for aerating the fuel prior to injection into the induction pipe leading to the engine is supplied after being filtered and measured by mass flow sensor but prior to passing through the throttle on fuel injector air supply rail 98 which supplies air in parallel to each of the fuel injectors and the outlet leg or passage 17. The fixed pressure regulator 53' need not be compensated as in the case illustrated in FIG. 3.

The above description relates to a preferred exemplary embodiment of the invention, it being understood that other embodiments and modifications thereof are possible within the spirit and scope of the invention as defined by thehe claims appended hereto.

What is claimed is:

1. In a fuel injection system for an internal combustion engine, said system having computer means for receiving a plurality of electrical signals corresponding to engine operating parameters and producing electrical control signals for supplying fuel to said engine, a bistable fluidic switch having a power nozzle coupled to a supply of fuel under pressure, a chamber having sidewalls leading to a common outlet and a pair of output channels receiving fuel issuing through said power nozzle, one of said channels leading to said internal combustion engine and the other of said channels leading to said supply, and electromagnetic means controlled by said control signals from said computer means for controlling the state of said bistable switch, the improvement comprising, a flow control pin controlled by said electromagnetic means and positioned to be interposed into and removed from a fluid flow path in said power nozzle to switch the state of said bistable switch and change the one of said output channels in which fuel flows.

2. The fuel injector system defined in claim 1 including means in the one of said output channels leading to said engine for isolating said fluidic switch from engine vacuum.

3. The fuel injector system defined in claim 1 including means in one of said output channels for supplying air to air atomize the fuel flowing therein.

4. The fuel injector defined in claim 1 including means for assuring that in the absence of said pin in the flow path of fuel, said bistable element is in a predetermined one of its stable states to issue fuel into said other of said channels.

5. The fuel injector defined in claim 4 wherein the axis of said power nozzle is at an angle relative to the axis of said chamber.

6. The fuel injector system defined in claim 1 in which there is a fuel injector for each cylinder of said engine, and a common fuel rail to each said bistable fluidic switch and a common fuel return rail connected to each said bistable switch.

7. In a fuel injector system for an internal combustion engine having an air intake manifold, said system having a computer means for receiving a plurality of electrical signals corresponding to selected engine performance parameters and producing electrical control signals for supply of fuel to said engine, electromagnetically controlled fuel injector means controlled by control signals for receiving fuel under pressure from a supply and delivering a quantity of fuel to said engine according to said control signals, the improvement comprising, said fuel means including a bistable fluidic switch controlled by said electrical signals, a short fuel passage coupling said fuel from said bistable fluidic switch to the air intake manifold of said a supply of air, and means for introducing air from said supply into said short fuel passage to operatively isolate said fluidic switch from engine vacuum without significantly affecting engine vacuum and to air atomize said fuel before injection of said fuel into said air intake manifold.

8. The fuel injector system defined in claim 7 wherein each said bistable fluidic switch includes:

a power nozzle coupled to said supply of fuel, a chamber for receiving fuel from said power nozzle, a pair of output passages, each of which is adapted to receive fuel when said bistable fluidic switch is in one or the other of its states, respectively, and means for switching the states of said bistable fluidic switch.

9. The fuel injector system defined in claim 8 wherein said means for switching includes a member movable into a position of intrusion in said power nozzle, a solenoid for controlling the position of said movable member, and means connecting said solenoid to said computer.

10. A liquid metering apparatus for a utilization system having computer means for producing electrical control signals for controlling the liquid flow to said utilization system comprising, bistable fluidic switch means, said bistable fluidic switch means having a diverging-converging reversing chamber in which the pressure is always greater than any downstream pressure, and a power nozzle having a throat area supplying liquid under pressure from a liquid supply to said diverging-converging reversing chamber and then through a common outlet to at least a pair of output channels, a pin member positioned in said throat area of said power nozzle for converting electronic control signals from said computer to fluid signals for controlling the switched state of said fluidic switch element, a first of said pair of output channels being connected to said common outlet for delivering liquid to said utilization system when said bistable fluidic switch is in one of its bistable states, a second of said pair of output channels being connected to said common outlet for returning said liquid to said liquid supply when said bistable fluidic switch is in the other of its bistable states, an electromagnetic means controlled by said electronic control signals for controlling said pin member to switch the states of said bistable fluidic switch element and control the amount of liquid flow to said first channel and said utilization system.

11. The liquid metering system defined in claim 10 wherein said diverging-converging reversing chamber is defined by sidewalls converging to said common outlet from said chamber such that liquid flow fills said common outlet so that the body of liquid flow therethrough isolates said chamber from downstream pressure conditions.

12. In a fuel control system for an internal combustion engine wherein liquid fuel is supplied to the engine from a liquid fuel supply through at least one fluidic control element having a first output channel leading to said engine and a second output channel returning liquid fuel to said fuel supply, said computer means having means for sensing a plurality of engine operating criteria and computing therefrom an optimum fuel flow rate for said engine and producing an electrical signal corresponding to said optimum fuel flow rate, and mean controlled by said electrical signal for producing a fluidic control signal, the improvement comprising, the liquid metering apparatus defined in claim 10, wherein said liquid supply is constituted by said liquid fuel supply, said bistable fluidic switch is said fluidic control element, means connected to said bistable fluidic switch control element for converting said electronic signals to fluidic signals for controlling said bistable fluidic switch control element to switch the fuel between said first and second output channels.

13. The fuel control system defined in claim 12 wherein said bistable fluidic switch element has an interaction region chamber of the type wherein the sidewalls first diverge from said power nozzle and then converge to a common outlet and which alternately feeds fuel to first one and then another output channel and liquid flow through said common outlet always fills said common outlet and isolates said chamber from said output channels and generates feedback signals for maintaining liquid flow to one of said at least a pair of output channels until switched by aid electronic signal and means in one of said output channels for supplying air to air atomize fuel flowing in said one of said output channels to said internal combustion engine.

14. A fuel injector system for an internal combustion engine wherein fuel is supplied to the engine from a fuel supply, at least one fluid control element having a first output channel leading to said engine for injection of fuel thereinto, and a second output channel returning fuel to said fuel supply, electronic computer means for sensing a plurality of engine operating criteria and computing therefrom an optimum fuel flow rate for said engine and producing an electrical signal corresponding to said optimum fuel flow rate, and means for converting said electrical signal to a fluid control signal, the improvement wherein, said fluid control element is a bistable fluidic switch element having a power nozzle, an interaction region having downstream converging sidewalls leading to a single outlet connected to said first and second output channels, said first output channel leading to said engine being constituted by a relatively short passageway, a supply of air, and means for introducing air from said supply into said relatively short passageway, said air being introduced in sufficient quantity to air atomize said fuel before injection to said internal combustion engine and isolate said bistable fluidic switch from engine vacuum without significantly affecting engine vacuum, means responsive to said electrical signals to transduce said electrical signals to fluidic signals for controlling the on/off states of said bistable fluidic switch element to switch the fuel between said first and second output channels.

15. The fuel injector system defined in claim 14 wherein said internal combustion engine is a multi-cylinder engine and there is a bistable fluidic switch element for each cylinder of said engine, and a separate said short passageway and means for introducing air from said supply, respectively.

16. In a bistable fluidic switch having a diverging-converging reversing chamber, a power nozzle for supplying a fluid under pressure from a supply to said diverging-converging reversing chamber, a common chamber outlet from said chamber and at least a pair of output channels connected to said common chamber outlet, the improvement comprising, said power nozzle having a throat area, and a coaxial passage leading thereto, a low mass pin member, means for mounting said member for movement to an intruding position and change the fluid flow pattern in said throat area, means for actuating said low mass pin member for movement to a position intruding in a fluid flow path to one side of the center line of said power nozzle, and means moving said low mass pin member to a non-intruding position.

17. The bistable fluidic switch defined in claim 16 wherein the center line of said power nozzle is canted at an angle relative to the center line of said diverging-converging reversing chamber.

18. The bistable fluidic switch defined in claim 17 wherein the angle of said bistable fluidic switch is canted is about 8 degrees.

19. The bistable fluidic switch defined in claim 16 wherein said means for actuating said low mass pin member includes an electromagnet, and a computer for supplying control signals to said electromagnet.

20. In a fuel injection system for an internal combustion engine, said system having computer means for receiving a plurality of electrical signals corresponding to engine operating parameters and producing electrical control signals for supplying fuel to said engine, a bistable fluidic switch having a power nozzle coupled to a supply of fuel under pressure, a chamber having sidewalls leading to a common outlet and a pair of output channels receiving fuel issuing through said power nozzle, one of said channels leading to said internal combustion engine and the other of said channels leading to said supply, and electromagnetic means controlled by said control signals from said computer means for controlling the state of said bistable switch, the improvement comprising, a flow control member controlled by said electromagnetic means and changeably positioned in a fluid flow path in said power nozzle in advance of said chamber to switch the state of said bistable switch and change the one of said output channels in which fuel flows.

21. The fuel injector system defined in claim 20 including means in the one of said output channels leading to said engine for isolating said fluidic switch from engine vacuum.

22. The fuel injector system defined in claim 20 including means in one of said output channels for supplying air to air atomize the fuel flowing therein.

23. The fuel injector defined in claim 20 including means for assuring that in the absence of said control member in the flow path of fuel, said distable element is in a predetermined one of its stable states to issue fuel into said other of said channels.

24. The fuel injector system defined in claim 20 which there is a fuel injector for each cylinder of said engine, and a common fuel rail to each said bistable fluidic switch and a common fuel return rail connected to each said bistable switch.

* * * * *